US006564482B2

(12) United States Patent
Ruvang

(10) Patent No.: US 6,564,482 B2
(45) Date of Patent: May 20, 2003

(54) EXCAVATING APPARATUS WITH CURVED ADAPTER/TOOTH POINT SLIDING PIVOTAL INTERFACE AREA

(75) Inventor: John A. Ruvang, Hickory Creek, TX (US)

(73) Assignee: G. H. Hensley Industries, Incorporated, Dallas, TX (US)

( * ) Notice: Subject to any disclaimer, the term of this patent is extended or adjusted under 35 U.S.C. 154(b) by 97 days.

(21) Appl. No.: 09/843,681

(22) Filed: Apr. 27, 2001

(65) Prior Publication Data

US 2002/0166268 A1 Nov. 14, 2002

(51) Int. Cl.[7] ..... E02F 9/28
(52) U.S. Cl. ..... 37/456
(58) Field of Search ..... 37/446, 450, 452, 37/455, 456

(56) References Cited

U.S. PATENT DOCUMENTS

| | | | | | |
|---|---|---|---|---|---|
| 1,263,874 | A | * | 4/1918 | Exton | 37/455 |
| 1,469,808 | A | | 10/1923 | Pemberton | |
| 1,805,527 | A | * | 5/1931 | Mekeel | 37/454 |
| 2,227,674 | A | | 1/1941 | Ratkowski | 37/142 |
| 2,256,488 | A | * | 9/1941 | Murtaugh | 37/455 |
| 2,689,419 | A | * | 9/1954 | Daniels et al. | 172/699 |
| 3,063,176 | A | * | 11/1962 | Larson | 172/713 |
| 3,082,555 | A | * | 3/1963 | Hill | 172/719 |
| 3,453,755 | A | * | 7/1969 | Trudeau | 37/456 |
| 3,574,962 | A | * | 4/1971 | Smith | 172/713 |
| 4,317,300 | A | | 3/1982 | Emrich et al. | 37/142 R |
| 4,326,348 | A | | 4/1982 | Emrich | 37/142 R |
| 4,980,980 | A | | 1/1991 | Schadov et al. | 37/142 R |
| 5,177,886 | A | | 1/1993 | Klett | 37/141 T |
| 5,224,282 | A | | 7/1993 | Swick | 37/453 |
| 5,713,145 | A | | 2/1998 | Ruvang | 37/458 |
| 5,718,070 | A | * | 2/1998 | Ruvang | 37/455 |
| 5,778,570 | A | * | 7/1998 | Eichelberger | 37/450 |
| 5,918,391 | A | * | 7/1999 | Vinas Peya | 37/452 |
| 5,937,551 | A | * | 8/1999 | Moehnke et al. | 37/456 |
| 5,956,874 | A | * | 9/1999 | Ianello et al. | 172/772.5 |
| 5,966,849 | A | * | 10/1999 | Moehnke et al. | 172/719 |
| 6,052,917 | A | * | 4/2000 | Matsumoto | 34/138 |
| 6,085,448 | A | * | 7/2000 | Gale et al. | 37/452 |
| 6,092,958 | A | * | 7/2000 | Gale | 37/456 |
| 6,151,812 | A | * | 11/2000 | Bierwith | 37/446 |
| H2020 | H | * | 5/2002 | Kesavan et al. | 37/455 |

OTHER PUBLICATIONS

Undated GH Hensley Drawing, "501 Nose and Tooth" No date given.

* cited by examiner

*Primary Examiner*—Thomas B. Will
*Assistant Examiner*—Kristine Florio
(74) *Attorney, Agent, or Firm*—Konneker & Smith, P.C.

(57) ABSTRACT

An excavating adapter/tooth point assembly has an interfit configuration in which the front end surface of the adapter base has a curved front surface portion that slidingly and complementarily engages a facing curved rear end surface portion of the tooth point. The adapter nose received in the tooth point pocket is somewhat smaller in cross-section that the pocket to permit a limited vertical rocking movement of the point relative to the adapter nose, about a connector structure captively retaining the point on the adapter nose, while transferring rearwardly directed excavating loads on the point to the curved sliding adapter/point interface area. Top and bottom sides Of a rear end portion of the point have curved ear projections which extend rearwardly and outwardly along the adapter base and function as built-in wear guards that protect underlying surface portions of the adapter base.

32 Claims, 2 Drawing Sheets

EXCAVATING APPARATUS WITH CURVED ADAPTER/TOOTH POINT SLIDING PIVOTAL INTERFACE AREA

BACKGROUND OF THE INVENTION

The present invention generally relates to excavating apparatus and, in a preferred embodiment thereof, more particularly provides an excavating adapter/tooth point assembly in which the tooth point is retained on a nose portion of the adapter for limited rocking motion relative thereto while a curved rear end surface area of the tooth point slidingly bears against a complementarily curved front surface area of a base portion of the adapter.

Large excavating buckets, dippers and the like are typically provided with a series of earth-cutting teeth which are each formed from two primary parts—a relatively large adapter, and a relatively small replaceable tooth point. The adapter has a base portion which is connectable to the forward lower lip of the bucket, and a tapered nose portion onto which the tooth point is removably secured, with the tapered adapter nose being received in an interior pocket portion of the point, by a suitable connecting pin or other connecting structure. Compared to that of the adapter, the useful life of the point is rather short—the adapter typically lasting through five or more point replacements until the tremendous earth forces and abrasion to which the adapter is subjected necessitates its replacement.

AS conventionally designed, adapter/tooth point assemblies of this type are configured in a manner such that the adapter nose has a tapered configuration and is snugly and complementarily received in a tapered interior pocket portion of the tooth point in a manner limiting vertical rocking movement of the point relative to the adapter during excavating operations. While this snug tapered interfit between the adapter nose and a replacement tooth point captively retained thereon has been a long-accepted design feature in conventional adapter/tooth point assemblies, it has at least one well known disadvantage arising from this purposely snug fit between the tooth point and the adapter nose.

Specifically, after the assembly has been used in excavation tasks, the tremendous front-to-rear loads imposed on the tooth point tends to rearwardly drive it along the tapered adapter nose to an extent elastically deforming the tooth point side walls in lateral directions which, in turn, tends to firmly clamp the tooth point onto the adapter nose to an extent which often renders the subsequent task of removing the worn point from the adapter nose an inordinately difficult one.

In view of this it can be seen that a need exists for an adapter/tooth point assembly in which this problem is eliminated or at least substantially reduced. It is to this need that the present invention is primarily directed.

SUMMARY OF THE INVENTION

In carrying out principles of the present invention, in accordance with a preferred embodiment thereof, specially designed excavating apparatus is provided that comprises an adapter illustratively securable to a front edge portion of an excavating lip structure, a wear member representatively in the form of a replaceable tooth point, and a connection structure which is representatively in the form of a connector pin.

The adapter has a base with a curved front surface, and a nose projecting forwardly from the curved front surface. The wear member has a curved rear surface through which a pocket area forwardly extends, the pocket area being configured to removably receive and laterally envelop the adapter nose, and the curvature of the rear wear member surface being complementary to that of the front surface of the adapter base. Preferably, the curved front surface of the adapter base has a forwardly convex curvature, the curved rear surface of the wear member has a forwardly concave curvature, and the curved front adapter base surface slidingly engages substantially all of the complementarily curved rear wear member surface. When the adapter nose is placed in the wear member pocket area, the connector structure is inserted through aligned openings in the adapter nose and wear member to releasably retain the wear member on the adapter.

According to a key feature of the present invention, when the wear member is operatively mounted on the adapter, and the curved rear wear member surface is slidingly and complementarily engaged with the curved front surface of the adapter base, the wear member is permitted to pivot relative to the adapter through a limited arc (generally centered about an axis rearwardly offset from the connector structure) in a manner causing the curved wear member rear surface to slide along the curved adapter base front surface. In this manner, reactive loads created by rearwardly directed operating forces on the wear member are desirably shifted to the curved adapter base surface as opposed to being positioned more forwardly on the adapter nose.

Representatively, the adapter nose has a stabilizing tip portion with a front end surface that engages an inner end surface of the wear member pocket area, and a lateral clearance area is defined within the pocket area around the adapter nose therein. This clearance area causes a portion of the stabilizing tip portion to act as an abutment surface that limits the pivotal movement of the wear member relative to the adapter. The clearance area also prevents the wear member from being tightly wedged on the adapter nose, thereby facilitating removal of the wear member from the adapter nose.

According to another feature of the invention, the wear member has a pair of opposite outer side walls which extend rearwardly past the curved rear surface of the wear member and define abrasion shield structures that protectively overlie opposite side surface portions of the adapter base.

Illustratively, the wear member has a pair of opposite first and second outer side walls through which an aligned pair of first and second connection openings extend into the pocket area, the adapter nose has a third connection opening extending therethrough in alignment with the first and second connection openings, and the connection structure extends through the first, second and third connection openings. Representatively, the connection structure extends along an axis parallel to and spaced forwardly apart from the axis about which the wear member is pivotable relative to the adapter, the first and second connection openings have non-circular shapes and have curvatures generally parallel to the curvature of curved front adapter base surface, and the third connection opening has a circular cross-section.

DETAILED DESCRIPTION

Figure 1:
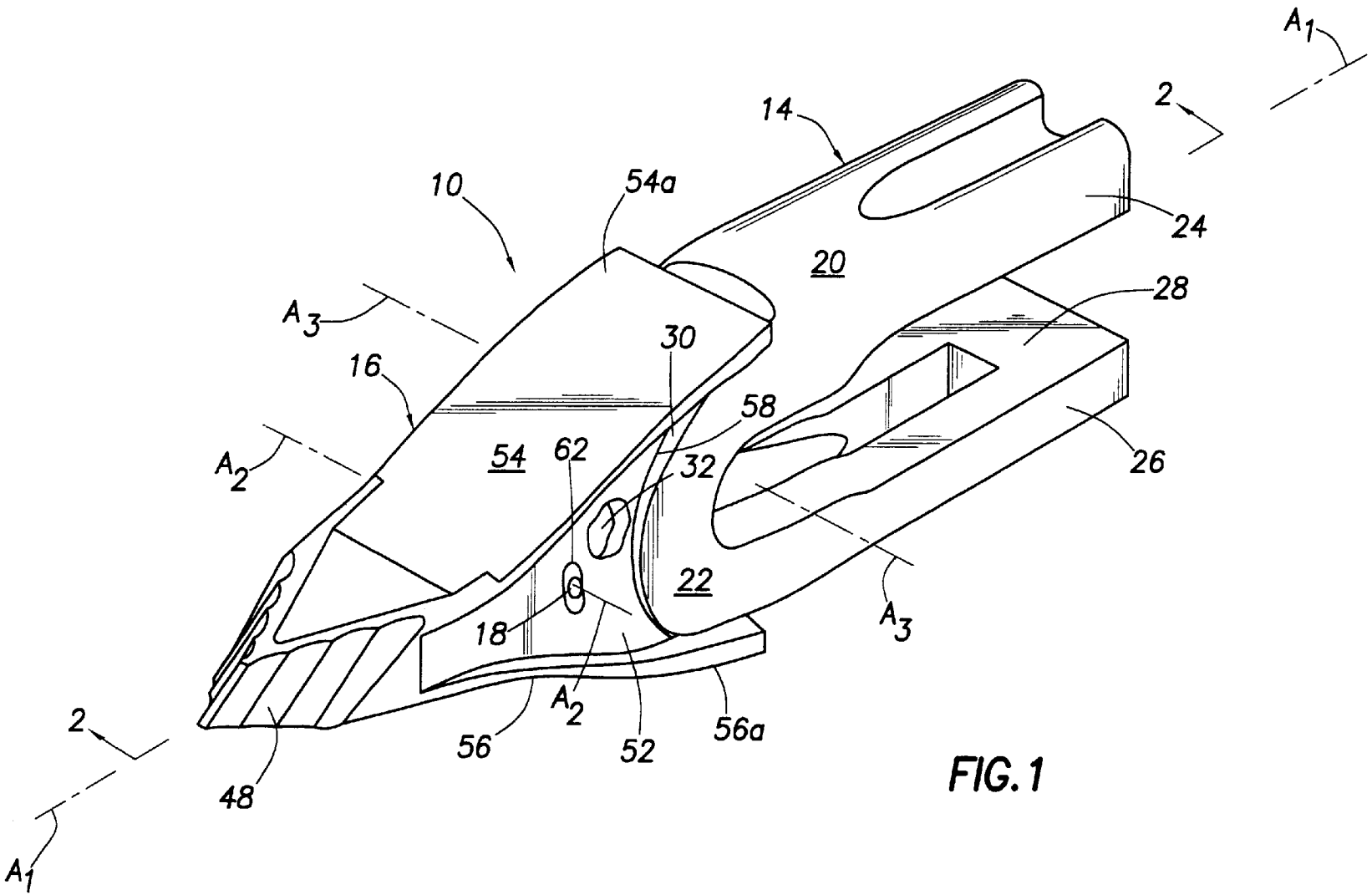
FIG. 1 is a partially cut away, somewhat simplified perspective view of a specially designed excavating adapter/tooth point assembly incorporating therein principles of the present invention.
Figure 2:
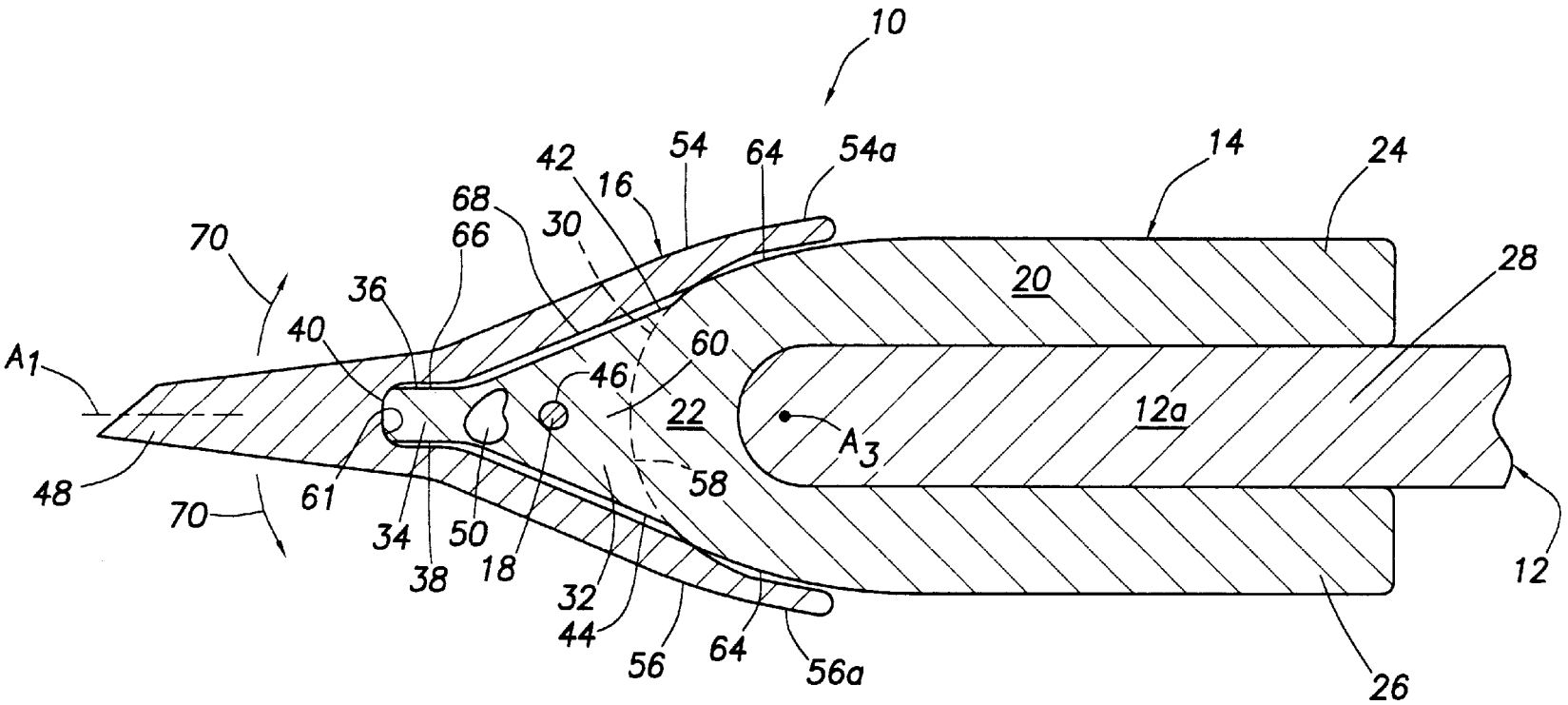
FIG. 2 is an enlarged scale, partially cut away, simplified cross-sectional view through the assembly taken generally along line 2—2 Of FIG. 1 and illustrating the assembly connected to a representative excavating bucket lip.

As illustrated in FIGS. 1 and 2, the present invention provides a specially designed adapter/tooth point assembly 10 which may be suitably secured to a front edge section 12*a* of a lip portion 12 of a bucket structure used in excavation operations. Assembly 10 is elongated in a left-to-right or front-to-rear direction and longitudinally extends along a horizontal axis $A_1$. The assembly 10 includes an adapter member 14, a wear member representatively in the form of a removable tooth point 16, and a suitable elongated connector structure 18 which is representatively a connector pin having a circular cross-section along its length, but which may be of an alternate construction if desired. Connector pin 18 longitudinally extends along a horizontal axis $A_2$ which is transverse to axis $A_1$.

The adapter 14 includes a generally U-shaped base portion 20 having a closed left or front end section 22 from which vertically spaced apart top and bottom side legs 24,26 rearwardly extend, legs 24,26 defining a cavity 28 therebetween. Front end section 22 has a forwardly facing, convexly curved outer end surface 30 from which a reduced cross-section tapered nose portion 32 forwardly projects, the rear end of the nose 32 being circumscribed by the convexly curved end surface 30 of the adapter base 20. Outer or front end surface 30 curves rearwardly about a horizontal axis $A_3$ which is parallel to and spaced rearwardly apart from the axis $A_2$. Adapter nose 32 has, at its front end, a stabilizing tip portion 34 with generally horizontal top and bottom sides 36,38 and a front end surface 40. Diverging top and bottom side surfaces 42,44 of the adapter nose 32 respectively slope upwardly and downwardly from the tip portion 34 to the convexly curved outer end surface 30. A circular connection opening 46, positioned rightwardly or rearwardly from the tip portion 34, extends horizontally through the adapter nose 32 between its opposite left and right sides as viewed from the front end of the adapter nose 32.

Tooth point 16 has a pointed leading or front edge portion 48, opposite left and right vertical side walls 50 and 52, and rearwardly and vertically diverging top and bottom side walls 54 and 56 disposed at the rear of the tooth point 16. The right or rear end surface 58 of the tooth point 16 has a forwardly concave curvature substantially identical to the forwardly convex curvature of the outer end surface 30 of the adapter base portion 20. A forwardly and inwardly tapered pocket 60 extends forwardly into the tooth point 16 through its concavely curved rear end surface 58 and is laterally enveloped by the outer side wall section of the tooth point 16. Pocket 60 has a shape generally complementary to that of the adapter nose 32, and forwardly terminates within the tooth point 16 at a vertical front end surface 61. Aligned connection openings 62 (only one of which is visible in the drawings) are formed through the opposite vertical side walls 50,52 and are spaced apart along the axis $A_2$. Openings 62 have non-circular configurations, are slightly elongated in the vertical direction, and are curved generally parallel to the curvature of rear tooth point surface 58. For purposes later described herein, the sloping top and bottom side walls 54,56 have rear portions 54*a*,56*a* that rearwardly extend past the top and bottom edges of the concavely curved rear end surface 58 of the tooth point 16.

The adapter 14 is operatively mounted on the front edge section 12*a* of the bucket lip 12 by placing the lip section 12*a* in the adapter cavity 28 and then securing the top and bottom adapter legs 24,26 to the lip section 12*a* in a suitable known manner not pertinent to the present invention. Tooth point 16 is mounted on the adapter 14 by inserting the adapter nose 32 into the point pocket 60, so that the entire lateral periphery of the inserted nose 32 is enveloped by the tooth point 16, and then inserting the connector pin 18 through the aligned tooth point openings 62 and the adapter nose opening 46. AS illustrated, the diameter of the connector pin 18 is somewhat less than the horizontal widths of the tooth point openings 62. In this manner, the pin 18 is protected against the imposition of rearwardly directed tooth point loads as the point/adapter interface areas begin to wear away prior to tooth point replacement.

With the tooth point 16 mounted on the adapter 14 in this manner, the front end surface 40 of the adapter nose tip portion 34 abuts the forward end surface 61 of the point pocket 60, and the concavely curved rear end surface 58 of the tooth point 16 slidingly and complementarily abuts the identically curved convex front end surface 30 of the adapter base 20 along essentially the entire extent of the curved tooth point surface 58. The rearwardly projecting portions 54*a*, 56*a* of the top and bottom walls 54,56 of the tooth point 16 respectively overlap and shield from abrasion front top and bottom exterior surface portions of the adapter base 20. For a purpose later described herein, the rearwardly projecting wall portions 54*a*,56*a* (which function as abrasion shield structures) are spaced outwardly apart from their underlying surface portions of the adapter base 20 and form gaps 64 therewith.

Although the adapter nose 32 and the point pocket 60 have generally complementary configurations, the point pocket 60 is slightly laterally oversized relative to the adapter nose 32 in a manner such that a small interior pocket surface lateral clearance 66 extends around the inserted adapter nose tip portion 34, and a somewhat larger interior pocket surface lateral clearance 68 extends around the balance of the inserted adapter nose 32. Representatively, but not by way of any limitation, the width of the lateral clearance 66 is approximately 0.030", and the width of the lateral clearance 68 is approximately 0.060". As will be readily appreciated by those of ordinary skill in this particular art, this designed-in lateral clearance between the adapter nose 32 and the interior surface of the tooth point pocket 60 is in sharp contrast to the snug lateral abutment conventionally provided between a tooth point pocket and an adapter nose operatively inserted therein.

This unique lateral clearance between the adapter nose 32 and the interior side surface of the point pocket 60, coupled with the sliding engagement between the complementarily curved and slidingly abutting adapter base and tooth point surfaces 30 and 58, permits the tooth point 16 to pivot upwardly and downwardly through a limited vertical arc, as indicated by the arrows 70, relative to the adapter nose 32 about the horizontal axis A3 during excavation operations. During this limited pivotal movement of the tooth point 16, the tooth point surface 58 slides along the corresponding adapter base surface 30, and the tooth point openings 62 are circumferentially shifted relative to opposite end portions of the pin 18.

The degree of clockwise and counterclockwise pivoting of the tooth point 16 relative to the adapter nose 32 is respectively limited by the abutment of a top point pocket interior surface area with the top side 36 of the adapter nose tip portion 34, and by the abutment of a bottom point pocket interior surface area with the bottom side 38 of the adapter nose tip portion 34. The gaps 64 between the rearward abrasion shielding extensions 54*a*,56*a* on the tooth point 16 and their underlying adapter base surfaces prevents the extensions 54*a*,56*a* from undesirably being brought into forcible contact with the adapter base 20 during this designed-in limited pivotal movement of the tooth point 16 and the adapter nose 32.

During excavation operations, rearward digging forces imposed on the tooth point 16 are transmitted from the front pocket surface 61 to the front end surface 40 of the stabilizing tip 34, with the reactive force being borne by convexly curved adapter base surface 30 which is pivotally and slidingly engaged by the correspondingly curved tooth point surface 58. This positioning of the reactive force directly on the adapter base 20 gives the assembly 10 a desirable strength advantage compared to conventional tooth point/adapter assemblies in which such reactive force is borne by the less massive adapter nose portion of the assembly.

The unique lateral clearance 66,68 extending around the adapter nose 32 advantageously prevents the adapter nose 32, in response to rearwardly directed digging forces imposed on the tooth point 16, from wedging into and elastically deforming the tooth point 16 in a manner causing the tooth point 16 to be frictionally locked onto the adapter nose 32 such that removal of the tooth point 16 from the adapter nose 32 becomes an inordinately difficult task.

As will readily be appreciated, the relatively small tooth point 16 functions as a replaceable wear member for the adapter nose portion 32 of the much larger adapter portion 14 of the overall assembly 10. However, the principles of the present invention are not limited to a tooth point/adapter assembly, and may be advantageously employed in a variety of other types of excavation assemblies in which a wear member is mounted on another excavation structure for limited pivotal movement relative thereto.

Also, while the tooth point 16 has been representatively illustrated and described herein as being pivotable relative to the adapter nose 32 about the horizontal axis $A_3$, the tooth point 16 (or another wear structure such as an intermediate adapter connected to the adapter 32) could also be pivotable about a differently oriented axis. Furthermore, the illustrated stabilizing adapter nose tip 34 could be shortened or eliminated, if desired, the result being that the pivotal stop surface area on the adapter nose 32, which functions to limit the pivotal movement of the tooth point 16 relative to the adapter 14 would be shifted rearwardly along the adapter nose 32.

Moreover, while the front surface 30 of the adapter base 20 has been representatively illustrated and described herein as having a forwardly convex curvature, and the rear surface 58 of the tooth point 16 has been representatively illustrated and described herein as having a forwardly concave curvature complementary to the curvature of the adapter base surface 30, it will be appreciated that these curvatures could be reversed, if desired, such that the front surface 30 and the rear surface 58 were respectively provided with complementary concave and convex curvatures.

The foregoing detailed description is to be clearly understood as being given by way of illustration and example only, the spirit and scope of the present invention being limited solely by the appended claims.

What is claimed is:

1. An excavating equipment adapter comprising:

a base having a rear portion connectable to an excavating lip structure, and a front portion having a curved front surface curving about a first axis; and a nose projecting forwardly from said curved front surface along a second axis transverse to said first axis and having a rear end circumscribed by said curved front surface, said nose being removably receivable in a socket area of a wear member and having a connector opening extending therethrough along a third axis parallel to said first axis, said curved front surface having a forwardly convex curvature.

2. The excavating equipment adapter of claim 1 wherein:

said rear portion of said base includes a spaced pair of legs extending rearwardly from said front portion of said base along opposite sides of a cavity adapted to receive a front edge portion of an excavating lip structure.

3. The excavating equipment adapter of claim 1 wherein:

aid nose has top and bottom sides spaced apart in a first direction transverse to said third axis.

4. The excavating equipment adapter of claim 1 wherein:

said nose has converging top and bottom side surface portions disposed forwardly of said curved front surface.

5. The excavating equipment adapter of claim 4 wherein:

said nose further has a stabilizing tip portion extending forwardly from forward ends of said converging top and bottom side surface portions, said stabilizing tip portion having substantially parallel top and bottom side surfaces.

6. Excavating apparatus comprising:

an adapter having a base with a curved front surface, and a nose projecting forwardly from said curved front surface;

a wear member having a curved rear surface through which a pocket area forwardly extends, said pocket area receiving said nose; and a connection structure disposed forwardly of said curved rear surface and removably retaining said nose within said pocket area, said front and rear surfaces being complementarily curved and engaged, said wear member being pivotable relative to said adapter through a limited arc in a manner causing said curved rear surface to slide along said curved front surface, and said wear member having a pair of opposite outer side walls which extend rearwardly past said curved rear surface and define shield structures that protectively overlie opposite surface portions of said base of said adapter rearwardly of said nose.

7. The excavating apparatus of claim 6 wherein:

said wear member is a replaceable tooth point.

8. The excavating apparatus of claim 6 wherein:

said adapter base has a rear portion connectable to an excavating lip structure.

9. The excavating apparatus of claim 6 wherein:

said rear portion of said adapter base has a spaced pair of leg structures disposed on opposite sides of a cavity adapted to receive a front edge portion of an excavating lip structure.

10. The excavating apparatus of claim 6 wherein:

said nose has a front end surface, and said pocket area has an inner end surface engaged by said front end surface of said nose.

11. The excavating apparatus of claim 6 wherein:

a clearance area extending laterally around said nose is defined between a side surface portion of said pocket area and a side surface portion of said nose, said clearance area permitting a portion of said nose to act as abutment for said wear member in a manner limiting its pivotal movement relative to said adapter.

12. The excavating apparatus of claim 11 wherein:

the lateral width of said clearance area adjacent a front end portion of said nose is less than the lateral width of said clearance area adjacent a rear end portion of said nose.

13. The excavating apparatus of claim 11 wherein:

said nose has a front stabilizing tip portion defining said front end portion of said nose.

14. The excavating apparatus of claim 6 wherein:

said curved front surface of said base of said adapter is curved about an axis, and said shield structures are positioned on opposite sides of said axis.

15. The excavating apparatus of claim 14 wherein:

clearance spaces are disposed between said shield structures and said opposite side surface portions of said base of said adapter.

16. The excavating apparatus of claim 6 wherein:

said wear member has a pair of opposite first and second outer side walls through which an aligned pair of first and second connection openings extend into said pocket area, said nose has a third connection opening extending therethrough in alignment with said first and second connection openings, and said connection structure extends through said first, second and third connection openings.

17. The excavating apparatus of claim 16 wherein:

said front surface of said base is curved about a first axis, and said connection structure extends along a second axis parallel to and spaced apart from said first axis, said second axis being disposed forwardly of said curved rear surface of said wear member.

18. The excavating apparatus of claim 17 wherein:

said first and second connection openings are curved about a third axis generally parallel to said first axis.

19. The excavating apparatus of claim 18 wherein:

said third connection opening has a circular cross-section.

20. The excavating apparatus of claim 6 wherein:

said curved front surface of said adapter base has a forwardly convex curvature, and said curved rear surface of said wear member has a forwardly concave curvature.

21. Excavating apparatus comprising:

an adapter having a base with a curved front surface, and a nose projecting forwardly from said curved front surface;

a wear member having a curved rear surface through which a pocket area forwardly extends, the curvature of said rear surface being complementary to that of said front surface, said pocket area being configured to receive said nose; and a connection structure for removably retaining said nose in said pocket area in a manner causing said curved front and rear surfaces to complementarily engage one another and permitting said wear member to pivot through a limited arc about said nose while causing said curved rear surface of said wear member to slide along said curved front surface of said base of said adapter, said wear member having a pair of opposite outer side walls which extend rearwardly past said curved rear surface and define shield structures positioned and configured to protectively overlie opposite side surface portions of said base of said adapter when said wear member is operatively mounted on said adapter.

22. The excavating apparatus of claim 21 wherein:

said wear member is a replaceable tooth point.

23. The excavating apparatus of claim 21 wherein:

said adapter base has a rear portion connectable to an excavating lip structure.

24. the excavating apparatus of claim 23 wherein:

said rear portion of said adapter base has a spaced pair of leg structures disposed on opposite sides of a cavity adapted to receive a front edge portion of an excavating lip structure.

25. The excavating apparatus of claim 21 wherein:

said nose has a front end surface, and said pocket area has an inner end surface engageable by said front end surface of said nose when said wear member is operatively mounted on said nose.

26. The excavating apparatus of claim 21 wherein:

said pocket area, along its front-to-rear length, has a lateral periphery greater than the lateral periphery of said nose along its front-to-rear length.

27. The excavating apparatus of claim 21 wherein:

said nose has a stabilizing tip portion at its front end.

28. The excavating apparatus of claim 21 wherein:

said curved front surface of said base of said adapter is curved about an axis, and said shield structures are positioned and configured to be disposed on opposite sides of said axis when said wear member is operatively mounted on said adapter.

29. The excavating apparatus of claim 21 wherein:

said curved front surface of said adapter base has a forwardly convex curvature, and said curved rear surface of said wear member has a forwardly concave curvature.

30. An excavating equipment wear member comprising a body having front and rear end portions spaced apart along a first axis; and a pocket area extending forwardly through said rear end portion into the interior of said body, said pocket area being configured to removably receive and laterally envelop a nose portion of an excavating equipment adapter and defining on said body opposite top and bottom outer side walls and opposite left and right outer side walls extending generally transversely to said opposite top and bottom outer side walls, said opposite left and right side outer side walls having forwardly and concavely curved rear end surfaces, said opposite top and bottom side walls having rear end sections projecting rearwardly beyond said opposite left and right outer side walls, and said opposite left and right outer side walls having aligned connector openings spaced apart along a second axis transverse to said first axis and disposed forwardly of said curved rear end surfaces of said opposite left and right outer side walls.

31. The excavating equipment wear member of claim 30 wherein:

said excavating equipment wear member is a replaceable tooth point.

32. The excavating equipment wear member of claim 30 wherein:

essentially the entire rear end surface of each Of said opposite left and right outer side walls is forwardly and concavely curved.

* * * * *

UNITED STATES PATENT AND TRADEMARK OFFICE

CERTIFICATE OF CORRECTION

PATENT NO. : 6,564,482 B2
DATED : May 20, 2003
INVENTOR(S) : John A. Ruvang

It is certified that error appears in the above-identified patent and that said Letters Patent is hereby corrected as shown below:

Column 6,
Line 13, change “aid” to -- said --.

Signed and Sealed this

Ninth Day of September, 2003

JAMES E. ROGAN
*Director of the United States Patent and Trademark Office*